US008328634B2

(12) United States Patent
Gauselmann

(10) Patent No.: US 8,328,634 B2
(45) Date of Patent: Dec. 11, 2012

(54) BONUS GAME DISPLAYING AND AWARDING SELECTED VALUES

(75) Inventor: Michael Gauselmann, Espelkamp (DE)

(73) Assignee: Spielo International Austria GmbH, Lubbecke (DE)

( * ) Notice: Subject to any disclaimer, the term of this patent is extended or adjusted under 35 U.S.C. 154(b) by 0 days.

(21) Appl. No.: 13/429,234

(22) Filed: Mar. 23, 2012

(65) Prior Publication Data

US 2012/0184355 A1 Jul. 19, 2012

Related U.S. Application Data

(62) Division of application No. 11/862,151, filed on Sep. 26, 2007, now Pat. No. 8,152,625, which is a division of application No. 10/658,566, filed on Sep. 8, 2003, now Pat. No. 7,291,066.

(51) Int. Cl.
*A63F 9/24* (2006.01)

(52) U.S. Cl. ..... 463/25; 463/16

(58) Field of Classification Search ..... 463/20
See application file for complete search history.

(56) References Cited

U.S. PATENT DOCUMENTS

| | | | | |
|---|---|---|---|---|
| 5,823,874 | A | 10/1998 | Adams | |
| 6,251,013 | B1 * | 6/2001 | Bennett | 463/13 |
| 6,290,600 | B1 * | 9/2001 | Glasson | 463/20 |
| 6,439,995 | B1 | 8/2002 | Hughs-Baird et al. | |
| 6,443,837 | B1 * | 9/2002 | Jaffe et al. | 463/16 |
| 6,517,432 | B1 * | 2/2003 | Jaffe | 463/16 |
| 6,572,472 | B1 | 6/2003 | Glavich | |
| 6,585,591 | B1 * | 7/2003 | Baerlocher et al. | 463/25 |
| 6,776,711 | B1 | 8/2004 | Baerlocher | |
| 6,786,818 | B1 * | 9/2004 | Rothschild et al. | 463/20 |
| 2003/0013517 | A1 | 1/2003 | Bennett et al. | |
| 2003/0013519 | A1 | 1/2003 | Bennett | |
| 2003/0022712 | A1 | 1/2003 | Locke | |
| 2003/0087686 | A1 | 5/2003 | Yu et al. | |
| 2003/0162585 | A1 * | 8/2003 | Bigelow et al. | 463/20 |
| 2004/0048644 | A1 | 3/2004 | Gerrard et al. | |
| 2004/0106444 | A1 * | 6/2004 | Cuddy et al. | 463/16 |
| 2005/0119040 | A1 | 6/2005 | Berman et al. | |

FOREIGN PATENT DOCUMENTS

| | | | |
|---|---|---|---|
| EP | 1063622 | A2 | 12/2000 |
| EP | 1082979 | A2 | 3/2001 |
| WO | 01/23381 | A1 | 2/2001 |
| WO | 0158546 | A1 | 8/2001 |

* cited by examiner

*Primary Examiner* — Tramar Harper
(74) *Attorney, Agent, or Firm* — Patent Law Group LLP; Brian D. Ogonowsky

(57) ABSTRACT

Various bonus games for being played on a gaming machine are described. The base game may consist of the random selection and display of a 5×3 matrix of symbols. In one bonus game (FIGS. 5-7), upon a certain outcome of the base game including special symbols, all symbols in the matrix except for the special symbols are replaced with values, such as different credit amounts. The player selects a particular special symbol using a touch screen, and the identified special symbol randomly moves to select one of the displayed values in the matrix. In another game (FIGS. 11-13), the player applies hidden multipliers to a randomly selected award value in the matrix. In another game (FIGS. 14-19), pointers moving across the matrix of values accumulate values for awarding to the player. The multi-stage interactive bonus games add excitement and more player involvement.

6 Claims, 5 Drawing Sheets

| | | | | |
|---|---|---|---|---|
| 100 | 50 | 25 | 10 | 75 |
| 50 | ? | ? | ? | 90 |
| 40 | 15 | 25 | 60 | 75 |

| | | | | |
|---|---|---|---|---|
| 100 | 50 | 25 | 10 | 75 |
| 50 | ? | x3 | ? | 90 |
| 40 | $ | 25 | 60 | 75 |

10

| | | | | |
|---|---|---|---|---|
| A | B | C | D | E |
| F | F | F | F | F |
| K | L | M | N | O |

| | | | | |
|---|---|---|---|---|
| A | B | C | D | E |
| F | G | H | $ | J |
| $ | $ | M | N | O |

| | | | | |
|---|---|---|---|---|
| 100 | 50 | 25 | 10 | 75 |
| 50 | 30 | 200 | 80 | 90 |
| 40 | 15 | 25 | 60 | 75 |

| | | | | |
|---|---|---|---|---|
| 100 | 50 | 25 | 10 | 75 |
| 50 | 30 | 200 | $ | 90 |
| $ | $ | 25 | 60 | 75 |

| | | | | |
|---|---|---|---|---|
| 100 | 50 | 25 | 10 | 75 |
| 50 | 30 | 200 | 80 | 90 |
| 40 | 15 | 25 | 60 | 75 |

| | | | | |
|---|---|---|---|---|
| 100 | 50 $ | 25 | 10 | 75 |
| 50 | 30 | 200 | 30 | 90 |
| $ | $ | 25 | 60 | 75 |

| | | | | |
|---|---|---|---|---|
| A | B | C | D | E |
| F | G | H | I | J |
| K | $ | M | N | O |

Fig. 8

| | | | | |
|---|---|---|---|---|
| A | B | C | D | E |
| F | F | F | F | F |
| K | L | M | N | O |

Fig. 11

| | | | | |
|---|---|---|---|---|
| 100 | 50 | 25 | 10 | 75 |
| 50 | 30 | 200 | 80 | 90 |
| 40 | $ | 25 | 60 | 75 |

Fig. 9

| | | | | |
|---|---|---|---|---|
| 100 | 50 | 25 | 10 | 75 |
| 50 | ? | ? | ? | 90 |
| 40 | 15 | 25 | 60 | 75 |

Fig. 12

| | | | | |
|---|---|---|---|---|
| 100 | 80 | 25 | 10 | 75 |
| 50 | 60 | 200 | 80 | 90 |
| 40 | 90 $ | 25 | 60 | 75 |

Fig. 10

| | | | | |
|---|---|---|---|---|
| 100 | 50 | 25 | 10 | 75 |
| 50 | ? | x3 | ? | 90 |
| 40 | $ | 25 | 60 | 75 |

Fig. 13

| | | | | |
|---|---|---|---|---|
| A | B | C | D | E |
| F | F | F | F | F |
| K | L | M | N | O |

Fig. 14

| | | | | | |
|---|---|---|---|---|---|
| | | | | 90 | x1 |
| | | | | 60 | x2 |
| | | | | 250 | x3 |

Award 220

Fig. 18

| | | | | | |
|---|---|---|---|---|---|
| | 20 | 30 | 100 | 90 | x1 |
| | x2 | x3 | 80 | 60 | x2 |
| | 30 | 60 | x2 | 250 | x3 |

Award 20

Fig. 15

| | | | | | |
|---|---|---|---|---|---|
| | | | | | x1 |
| | | | | x2 | |
| | | | | | x3 |

Award 440

Fig. 19

| | | | | | |
|---|---|---|---|---|---|
| | | 30 | 100 | 90 | x1 |
| | | x3 | 80 | 60 | x2 |
| | | 60 | x2 | 250 | x3 |

Award 50

Fig. 16

| | | | | | |
|---|---|---|---|---|---|
| | | | 100 | 90 | x1 |
| | | | 80 | 60 | x2 |
| | | | x2 | 250 | x3 |

Award 130

Fig. 17

BONUS GAME DISPLAYING AND AWARDING SELECTED VALUES

CROSS-REFERENCE TO RELATED APPLICATIONS

This application is a divisional of U.S. application Ser. No. 11/862,151, filed on Sep. 26, 2007, which is a divisional of U.S. application Ser. No. 10/658,566, filed on Sep. 8, 2003, both incorporated herein by reference.

FIELD OF THE INVENTION

This invention relates to gaming machines and, in particular, to bonus games played in conjunction with a main game on a gaming machine.

BACKGROUND

Many gaming machines, also referred to as slot machines, include a bonus game feature to add variety and excitement. In one example, the main game is a video version of a reel-type slot machine, where video reels appear to rotate and stop to display a combination of symbols across one or more activated paylines. Certain combinations of symbols across a payline correspond to an award paid to the player, and certain combinations of symbols initiate a bonus game. The bonus game may be either a variation of the main game or a completely different game. An outcome of the bonus game determines a bonus award to the player.

What is needed are more interesting and exciting bonus games.

SUMMARY

Various bonus games for being played on a gaming machine are described. Suitable gaming machines include stand-alone machines, linked gaming machines, on-line gaming machines (e.g., a home computer interacting with a game server via the Internet), mobile devices, and other devices.

The bonus game may be initiated as a reward for achieving a certain outcome in a main game. The main game may be the random display of symbols across one or more activated paylines, where certain combinations of symbols correspond to awards paid to the player. One or more combinations of symbols initiate the bonus game.

In one embodiment, the main game and bonus game are played on a video screen. The main game may consist of the random selection and display of a 5×3 matrix of symbols, although any size array of symbols may constitute the main game. Upon a certain outcome of the main game, all or some of the symbols in the array are replaced with values, such as different credit amounts. Each value represents a potential bonus award to the player. Various bonus games are described that select one or more displayed values as the outcome of the bonus game.

In one embodiment, a multiplier is randomly selected, and the bonus award is multiplied by the selected multiplier. The player then wins the multiplied award as a bonus.

BRIEF DESCRIPTION OF THE DRAWINGS

FIG. 8 illustrates another embodiment of the invention, where a special symbol ("$") has been displayed in a column of symbols in the main game, initiating a bonus game.

FIG. 9 illustrates how the occurrence of the special symbol in FIG. 8 converts the other displayed symbols into credit values that may be won by the player.

FIG. 10 illustrates how the "reel" displaying the column of values in the same column as the special symbol in FIG. 9 spins and stops to award the player the value displayed at the special symbol position.

FIG. 11 illustrates another embodiment of the invention where a certain symbol combination has been displayed in the main game, initiating a bonus game.

FIG. 12 illustrates how the occurrence of the symbol combination in FIG. 11 converts the center three positions to question marks and the surrounding positions to values.

FIG. 13 illustrates that the player has selected the center question mark, which became identified as a x3 multiplier, and a value has been randomly selected for being multiplied by the x3 multiplier as a bonus award.

FIG. 14 illustrates another embodiment of the invention where a certain symbol combination has been displayed in the main game, initiating a bonus game.

FIGS. 15-19 illustrate how the occurrence of the symbol combination in FIG. 14 converts the displayed symbols into values, and arrow directions are randomly selected that are used to identify bonus awards to the player.

DETAILED DESCRIPTION

FIGS. 1-23 illustrate examples of a display screen 10 in a video gaming machine. Examples are given for a video gaming machine that displays the random selection of a 5×3 array of symbols. However, the invention applies to any arrangement of symbols, including 3×3, 4×4, 3×1, and other arrays.

Figures 1, 2, 3, 4, 5, 6, 7:
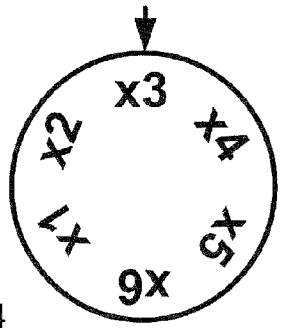
FIG. 1 illustrates a display screen of a gaming machine in accordance with one embodiment of the invention, where a special symbol combination has occurred in the main game, giving rise to a bonus game.
FIG. 2 illustrates the display after the symbols in FIG. 1 have been converted to credit values that may be won by the player during the bonus game.
FIG. 3 illustrates the display screen after a row and column have been randomly selected to identify the bonus award.
FIG. 4 illustrates a multiplier that randomly selects a multiplier of the bonus award value identified in FIG. 3.
FIG. 5 illustrates another embodiment of the invention, where special symbols ("$") have been displayed in the main game, initiating a bonus game.
FIG. 6 illustrates how the occurrence of the special symbol in FIG. 5 converts the other displayed symbols into credit values that may be won by the player, where touching the special symbol causes the special symbol to randomly select one of the displayed credit values as a bonus award to the player.
FIG. 7 illustrates how one of the special symbols in FIG. 6 has selected a 50 credit bonus award.

The first embodiment of the invention relates to FIGS. 1-3 and is a bonus feature for a main game. The main game is also referred to as a base game. In the example given, the trigger event for the bonus feature is a special combination of symbols across a payline.

In the example of FIG. 1, the main game consists of the player betting a number of credits, then spinning virtual reels (each reel representing a column of symbols) by pressing a button. The gaming machine randomly determines the stop position of the reels. A pay table ROM determines whether the symbol combinations across activated paylines correspond to an award to the player, and the appropriate number of credits is then added to a credit meter. There may be any number of paylines that extend across the five columns of the array and intersect any symbol positions across the columns.

FIG. 1 illustrates an outcome of the main game, where the player has achieved five of the same symbols ("F") across the center payline. This outcome in the main game initiates a bonus game. Additionally, the player may also win an instant award for the symbol combination. The designer of the game may make any symbol combination or another triggering event (e.g., a random time, etc.) initiate the bonus feature. Conventional hardware and software techniques may be used to determine that the triggering event has occurred and, in response, initiate the bonus game routine.

As shown in FIG. 2, in response to the bonus feature being initiated, each symbol displayed in FIG. 1 is replaced by a value so the player sees a 5×3 array of values. Each value may represent a number of credits that will be awarded to the player if selected. In one embodiment, the values are randomly determined for each symbol position. In another embodiment, each symbol has a predetermined value associated with it. When the player sees the various high value awards in the array, the player anticipates winning one of the high value awards, which adds excitement to the game.

As shown in FIG. 3, one of the award values is selected at random by the gaming machine. In the example of FIG. 3, the intersection of the fourth column and second row was selected by the gaming machine, thus awarding the player a bonus award of 80 credits. The presentation of the selection of the particular bonus value may take on any form. For example, various rows may be sequentially highlighted until only one row is eventually highlighted. Next, the columns are sequentially highlighted until only one of the columns is highlighted. The intersection of the row and column is the award granted to the player. Other types of presentations may include the sequential or random highlighting of each of the values, where only one of the values eventually remains highlighted as the selected value.

The values displayed in FIGS. 2 and 3 may be dependent upon the amount bet by the player, where a two-credit bet during the main game may double the values displayed in FIGS. 2 and 3.

In one embodiment, the bonus feature also includes a multiplier, such as that shown in FIG. 4. The multiplier may be displayed to the player on a video screen or may be a mechanical wheel or other device. The video or mechanical multiplier spins to randomly select a multiplier for the bonus award. In the example of FIG. 4, the multiplier value is x3, resulting in a total bonus award to the player of 240 credits. The multiplier may be presented using any type of technique.

Another type of bonus feature is described with respect to FIGS. 5-7. In one embodiment, the video screen is a touch screen, where a sensor detects the X-Y coordinates of the player's touch on the screen. The touching of a coordinate initiates an associated function to be performed.

Among the various symbols that may be displayed during the main game is a special symbol, shown in FIG. 5 as a "$" symbol. When a special symbol is displayed in the main game, and after the player has been paid any instant wins for the outcome of the main game, the various other symbols are replaced by values, as shown in FIG. 6. In another embodiment, the bonus feature is only enabled with a certain combination of special symbols either across a payline or scattered. When multiple special symbols are displayed, the player may touch the multiple special symbols for winning multiple bonus awards. Bonus games may also be initiated at random times.

The player then touches the special symbol (shown in FIG. 6 as the highlighted $ symbol), and this special symbol then moves from its position and randomly lands on any other position on the array to award the player that bonus value. In the example of FIG. 7, the $ symbol has landed on the value in the first row, second column, resulting in an award of 50 credits to the player. This value may further be multiplied by the multiplier of FIG. 4. In one embodiment, the special symbol is a butterfly symbol which, when touched by the player, appears to fly over the array and alights on one of the values.

In the example of FIGS. 5-7, three special $ symbols have been displayed in the main game. The player may touch each of the symbols to win three bonus awards. In one embodiment, if touching one of the special symbols results in that special symbol landing on another special symbol, awards may be doubled, or other suitable events may occur. The special symbol, when touched, may even land on its own position, which has a value associated with it.

A third type of bonus game is described with respect to FIGS. 8-10. The outcome of the main game, shown in FIG. 8, includes a special symbol, shown as a "$" symbol. In response to the display of the special symbol in the main game, the other symbols change into values, as shown in FIG. 9. In another embodiment, the bonus feature is only enabled with a certain combination of special symbols either across a payline or scattered.

The "reel" containing the special symbol then spins (thus changing the second column of values) while the other values remain stationary. The special symbol does not change its position and appears to be superimposed over changing values in the second column. Ultimately, the reel stops spinning, and the value beneath the special symbol is the bonus value awarded to the player. In the example of FIG. 10, the award value is 90 credits. If multiple special symbols are displayed, the player may select multiple reels for the bonus game.

In all embodiments, the value may then be multiplied by a randomly selected multiplier. Further, all values may be increased upon the player betting above the minimum bet in the main game. Betting higher amounts may provide the player additional spins to have multiple chances to win a bonus award or may increase the displayed values.

A fourth type of bonus game is described with respect to FIGS. 11-13. FIG. 11 shows the outcome of the main game. A special symbol combination of five F symbols is assumed to trigger the bonus game. As shown in FIG. 12, after any instant awards are paid out for the main game, the center three symbol positions display a question mark symbol, and the remaining symbol positions display values. The player then selects one of the "?" symbols as a multiplier. The selection may be via a touch screen.

FIG. 13 illustrates that the player selected the center "?" symbol, which is a ×3 multiplier. The surrounding values are then sequentially or randomly highlighted, and a randomly selected value eventually remains highlighted. The award to the player is the value multiplied by the multiplier, in this case 150 credits. Any presentation for selecting a multiplier and the bonus value may be used. In another embodiment, the player selects a hidden value, and a multiplier is randomly selected by the gaming machine. The random selection by the machine may be by a random number generator.

FIGS. 14-19 illustrate a fifth type of bonus game. FIG. 14 shows the outcome of the main game. A special symbol combination of five F symbols is assumed to trigger the bonus game. As shown in FIG. 15, after any instant awards are paid out for the main game, the symbols become values or a combination of values and multipliers. The symbols on the first reel become arrows for pointing to a position on the second reel or out of the display screen. Other arrow directions may also be used. The first reel spins and randomly stops. FIG. 15 illustrates the stopped position of the first reel. The center arrow (or other arrow) is highlighted as the active arrow. The highlighted arrow on the first reel may be randomly chosen, or may always be the arrow on the center line, or may be an arrow chosen in another manner. The selected arrow points to the top position of the second reel, which identifies the bonus award of 20 credits. The symbols on the second reel become arrows, and the second reel then spins and stops, as shown in FIG. 16, to point to a value on the third reel. The process repeats for each reel, as shown in FIGS. 17-19. If an arrow points outside the screen, the bonus game is over, and the player receives the accumulated awards. The player may instead lose all the accumulated bonus awards and win a consolation prize. If the player gets to the final reel, the last spin determines a multiplier (FIG. 19). The player receives the accumulated bonus values multiplied by the multiplier. Many variations of this presentation to grant the player bonus awards are envisioned.

In another embodiment of the game of FIGS. 14-19, the arrows on the reels may also point backwards to point to values on a left reel. The values may even be doubled or subtracted.

Figure 20:
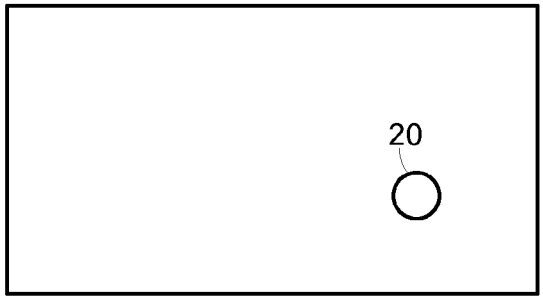
FIGS. 20-23 illustrate a game that may be the main game or a bonus game, where the player guesses under which triangle (or any other image) an object is hidden after the triangles are moved around. An award is given for the correct answer.
Figure 20:
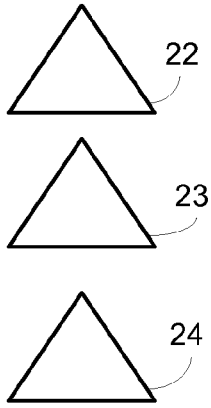
Figure 21:
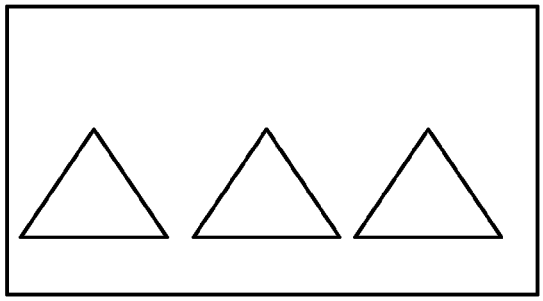
Figure 22:
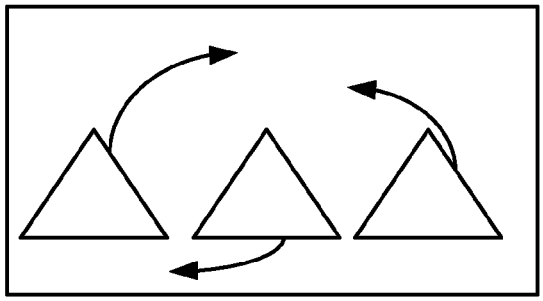
Figure 23:
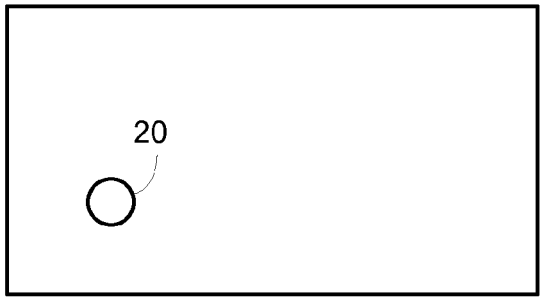

FIGS. 20-23 illustrate a sixth type of game that may be a bonus game or a main game. FIGS. 20-23 represent screen displays on a gaming machine. In FIG. 20, the player is presented with a ball 20 in one of three possible positions and three triangles 22-24. The triangles may be hats, shells, or any other object that the ball can fit under. The player places a bet by, for example, pressing a bet button. As shown in FIG. 21, one triangle then covers the ball, and the other two triangles are positioned alongside it. The player then presses a "mix" button, and the triangles randomly move around the screen, as shown in FIG. 22. After the mixing is complete, the player selects the triangle that she believes has the ball under it. As shown in FIG. 23, the triangles are removed to reveal the position of the ball. If the player chose correctly, the player wins her bet. If the player chose incorrectly, the player loses her bet. Various other types of objects may be used in this game along with any type of presentation. In one embodiment, the bonus game is initiated upon a special symbol combination in the main game.

Figure 24:
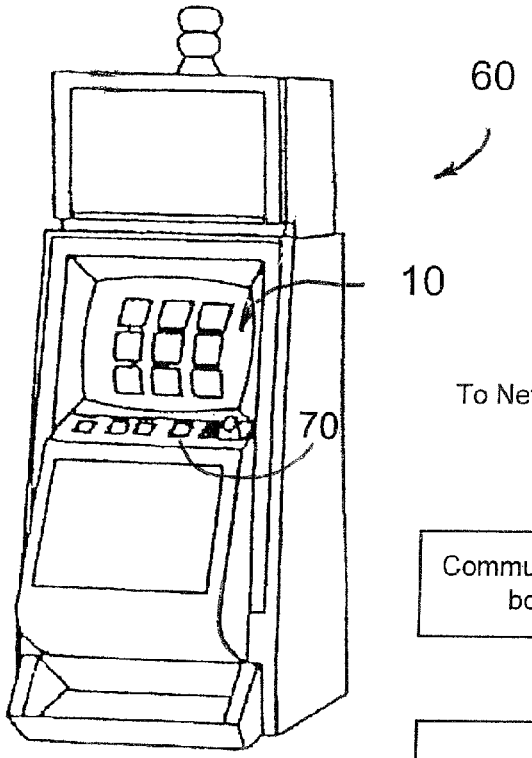
FIG. 24 is a perspective view of a stand-alone gaming machine that may be programmed to carry out the present invention.

FIG. 24 illustrates one type of video gaming machine 60 that may incorporate the present invention. Machine 60 may be a stand-alone machine or a machine connected in a network. A video screen 10 displays the main game and the bonus game. Alternately, the bonus game can be displayed on a separate screen. Where appropriate, the bonus game can be displayed on a video screen, and the main game may be displayed by motor-driven reels. Buttons 70 control aspects of the game, such as betting and spinning the actual or virtual reels. The machine 60 is equipped with a conventional coin slot and a coin hopper for depositing coins in an output tray. Other forms of payment, such as bills, smart cards, player cards, and paper tickets, may also be received and paid out by machine 60.

Figure 25:
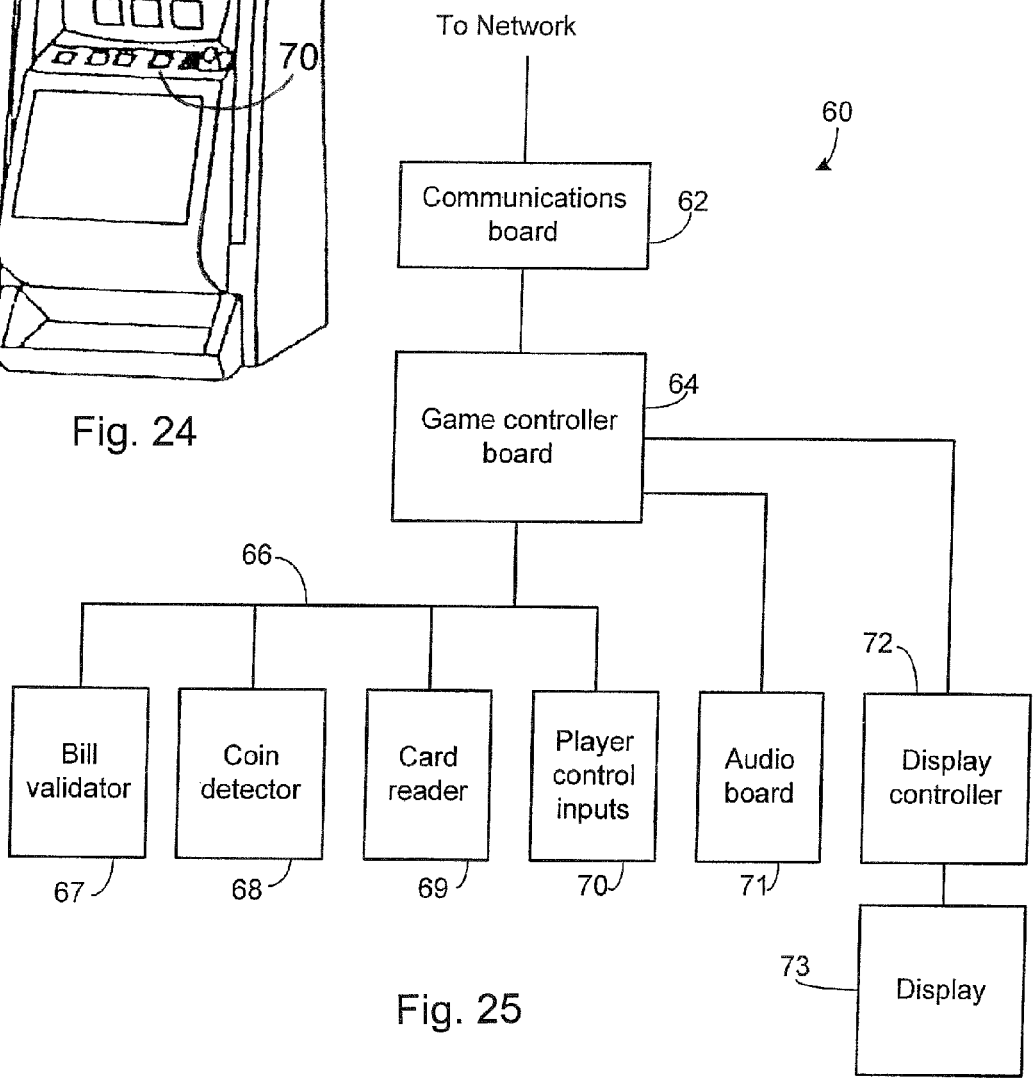
FIG. 25 illustrates various functional units in a conventional gaming machine programmed to carry out the present invention.

FIG. 25 illustrates functional units in a conventional gaming machine 60 that is programmed to carry out the inventive game. The gaming machine 60 may use conventional hardware. A communications board 62 may contain conventional circuitry for coupling the gaming machine 60 to a local area network (LAN) or other type of network using Ethernet or any other protocol. The game controller board 64 contains memory and a processor for carrying out programs stored in the memory and for providing the information requested by the network. The game controller board 64 primarily carries out the game routines.

Peripheral devices/boards communicate with the game controller board 64 via a bus 66 using, for example, an RS-232 interface. Such peripherals may include a bill validator 67, a coin detector 68, a smart card reader or other type of credit card reader 69, and player control inputs 70 (such as buttons or a touch screen). An audio board 71 converts coded signals into analog signals for driving speakers. A display controller 72 converts coded signals to pixel signals for the display 73. Display controller 72 and audio board 71 may be directly connected to parallel ports on the game controller board 64.

The inventive games may also be played on-line via the Internet, and any suitable computer and display device, such as a home computer or a mobile telephone, may be used to play the game.

Having described the invention in detail, those skilled in the art will appreciate that given the present disclosure, modifications may be made to the invention without departing from the spirit and inventive concepts described herein. Therefore, it is not intended that the scope of the invention be limited to the specific embodiments illustrated and described.

What is claimed is:

1. A method performed in a gambling game comprising:

displaying an array of symbols on a display screen in a base game at symbol positions having at least one row and a plurality of columns;

detecting a trigger event, by a computer system, that enables a bonus feature;

converting, by the computer system, a plurality of the symbols displayed to a plurality of displayed award values and a plurality of hidden multiplier values located at the symbol positions such that a player sees all the award values and sees icons representing the hidden multipler values corresponding to the symbol positions randomly selecting, by the computer system, at least one of the values from the displayed award values but not all of the displayed award values;

detecting, by the computer system, that one of the hidden multipliers has been selected by the player; and awarding a player a bonus award based on the randomly selected at least one of the values multiplied by the multiplier selected by the player.

2. The method of claim 1 wherein the icons are displayed in a center portion of the symbol positions.

3. The method of claim 1 wherein the computer system is part of a stand-alone machine.

4. The method of claim 1 wherein the computer system comprises a system connected in a network.

5. The method of claim 1 wherein the computer system comprises a system connected to the Internet.

6. The method of claim 1 wherein the computer system comprises a mobile telephone.

* * * * *